US008206521B2

(12) United States Patent
Kikuchi et al.

(10) Patent No.: US 8,206,521 B2
(45) Date of Patent: Jun. 26, 2012

(54) HIGH-STRENGTH STABILIZER STEEL FOR VEHICLES HAVING EXCELLENT CORROSION RESISTANCE AND LOW-TEMPERATURE TOUGHNESS, METHOD OF PRODUCING THE SAME, AND STABILIZER

(75) Inventors: Katsuhiko Kikuchi, Sendai (JP); Kunikazu Tomita, Sendai (JP); Yutaka Tamai, Sendai (JP); Kazuaki Hattori, Sendai (JP); Kanji Inoue, Yokohama (JP); Akira Tange, Yokohama (JP); Norihiko Mori, Yokohama (JP); Yurika Goto, Yokohama (JP); Kiyoshi Kurimoto, Yokohama (JP)

(73) Assignees: NHK Spring Co., Ltd., Yokohama-shi (JP); JFE Bars & Shapes Corporation, Tokyo (JP)

( * ) Notice: Subject to any disclaimer, the term of this patent is extended or adjusted under 35 U.S.C. 154(b) by 0 days.

(21) Appl. No.: 13/207,600

(22) Filed: Aug. 11, 2011

(65) Prior Publication Data

US 2011/0290382 A1 Dec. 1, 2011

Related U.S. Application Data

(63) Continuation of application No. PCT/JP2010/051991, filed on Feb. 10, 2010.

(30) Foreign Application Priority Data

Feb. 12, 2009 (JP) ..... 2009-030173

(51) Int. Cl.
*C21D 1/00* (2006.01)
*C22C 38/42* (2006.01)

(52) U.S. Cl. ..... 148/567; 148/332; 420/91

(58) Field of Classification Search ..... 148/567, 148/566, 332; 420/91
See application file for complete search history.

(56) References Cited

U.S. PATENT DOCUMENTS 2,751,291 A * 6/1956 Carter et al. ..... 420/87
3,365,343 A * 1/1968 Vordahl ..... 420/36

(Continued)

FOREIGN PATENT DOCUMENTS

JP 2-4944 A 1/1990

(Continued)

OTHER PUBLICATIONS

Machine translation of JP 2008-095156 (translation of document published Apr. 24, 2008).*

(Continued)

*Primary Examiner* — Jonathan Johnson
(74) *Attorney, Agent, or Firm* — Holtz, Holtz, Goodman & Chick, PC

(57) ABSTRACT

According to one embodiment, a high-strength stabilizer steel for vehicles having excellent corrosion resistance and low-temperature toughness, containing 0.07 to 0.20% C, more than 0.6% and 1.5% or less Si, 1 to 3% Mn, 0.1 to 1.0% Cr, 0.005 to 0.080% sAl, 0.005 to 0.060% Ti, 0.005 to 0.060% Nb, 0.070% or less Ti+Nb, 150 ppm or less N, 0.035% or less P, 0.035% or less S, 0.01 to 1.00% Cu, 0.01 to 1.00% Ni, the remainder being Fe, and unavoidable impurities, wherein a structure before molding a stabilizer is any one of a bainite, a martensite, and a mixed structure of bainite/martensite and an original austenitic crystal grain size number after a heat treatment of the stabilizer is Gh 9 or more.

3 Claims, 2 Drawing Sheets

U.S. PATENT DOCUMENTS

| | | | | | |
|---|---|---|---|---|---|
| 3,408,178 | A | * | 10/1968 | Myers et al. | 420/49 |
| 4,086,085 | A | * | 4/1978 | McGurty | 420/43 |
| 4,273,838 | A | * | 6/1981 | Biemiller | 428/683 |
| 5,252,148 | A | * | 10/1993 | Shigeta et al. | 148/307 |

FOREIGN PATENT DOCUMENTS

| | | | |
|---|---|---|---|
| JP | 2000-17390 | A | 1/2000 |
| JP | 3409277 | B2 | 2/2003 |
| JP | 2005-2365 | A | 1/2005 |
| JP | 2006-89783 | A | 4/2006 |
| JP | 2006-89785 | A | 4/2006 |
| JP | 2008-95156 | A | 4/2008 |

OTHER PUBLICATIONS

International Search Report dated May 18, 2010 (in English) in counterpart International Application No. PCT/JP2010/051991.

* cited by examiner

HIGH-STRENGTH STABILIZER STEEL FOR VEHICLES HAVING EXCELLENT CORROSION RESISTANCE AND LOW-TEMPERATURE TOUGHNESS, METHOD OF PRODUCING THE SAME, AND STABILIZER

CROSS REFERENCE TO RELATED APPLICATIONS

This application is a Continuation Application of PCT Application No. PCT/JP2010/051991, filed Feb. 10, 2010 and based upon and claiming the benefit of priority from prior Japanese Patent Application No. 2009-030173, filed Feb. 12, 2009, the entire contents of all of which are incorporated herein by reference.

BACKGROUND OF THE INVENTION

1. Field of the Invention

The present invention relates to a high-strength stabilizer steel for vehicles which is mainly used for vehicles and a method of producing the same, particularly to a stabilizer having a high tensile strength of 1100 MPa or more and excellent corrosion resistance and low-temperature toughness.

2. Description of the Related Art

A stabilizer bar (hereinafter simply referred to as a stabilizer) is a spring component having a function in which, for running stability of vehicles, particularly during rotating, the stabilizer is twisted and displaced in an opposite direction to horizontal shaking loads transmitted from wheels via a suspension mechanism and an excessive tilt of the vehicle body is prevented by reducing the horizontal shaking loads working on the suspension mechanisms on either side. Since it is exposed to such a usage environment, the frequency of repeated load which is applied to the stabilizer is generally lower than that of a coil spring. On the other hand, the load applied to the stabilizer is accompanied by acceleration and thus sufficient strength, durability, and toughness higher than that of the coil spring are required for a steel which is used as a material. A carbon steel such as S48C and a spring steel such as JIS SUP9 have been used for conventional stabilizers. For example, a process of manufacturing these steels includes cutting a hot-rolling steel material into a predetermined size, performing a hot bending/molding process, adjusting to a predetermined strength by a heat-treating process for hardening and tempering, and then, subjecting the surface to shot peening, and finally coating for corrosion protection.

Recently, a demand of reduction in weight based on an increase in strength of underbody components aiming at the fuel consumption improvement of vehicles has been further increased. On the other hand, in the stabilizer field, a high-strength stabilizer of 1000 MPa or more has been developed. For example, a non-heat treated steel for spring having a strength of 120 to 150 kgf/mm$^2$ obtained by adding a proper amount of Ti, Nb, and B, particularly an amount of 0.08% or more of Ti and Nb is proposed in Patent document 1.

Patent document 1: Jpn. Pat. Appln. KOKAI Publication No, 3409277

BRIEF SUMMARY OF THE INVENTION

Although the stabilizer for vehicles is subjected to coating to ensure corrosion protection performance, it is structurally exposed to the outside of the vehicle. Therefore, concave scratches and coat peeling are easily caused by stepping stones while the vehicle is moving. There is a concern that the corrosion is progressed, particularly from a portion where the coating is peeled and components are damaged by the fatigue crack propagation originated from the corrosion portion. During winter, a snow melting agent for antifreezing is spread in many cases. Consequently, the corrosive environment is increasingly severe. Under the circumstances, the corrosion protection by only coating is not sufficient.

Generally, if the steel material has high strength, ductile toughness is deteriorated. In the case of a spring, if the ductile toughness of the steel material is low, when the concave scratches and corroded pores are caused by the above reason, the crack propagation resistance originated therefrom is reduced and a risk of easy breakage is increased. Therefore, high strength and high toughness are essential characteristics. Improvement in toughness (low-temperature toughness) in a cold state, particularly during winter season when the corrosive environment is severe is very important. Although Patent document 1 focuses on high strength, it does not focus on the corrosion resistance and low-temperature toughness.

The present invention has been made under such circumstances and its object is to provide a stabilizer steel for vehicles having excellent corrosion resistance and low-temperature toughness in which the corrosion resistance of the material itself is improved and the tensile strength is 1100 MPa or more and the method of producing the same.

In order to solve the above-described problems, the present inventors have been dedicated to making repetitive studies. As the result, they have had findings below.

(i) First, in order to improve the corrosion resistance of materials, a produced amount of carbon nitrides which develop into corrosion pits easily is limited. Specifically, corrosion resistance-enhancing effects are given by reducing carbon, normalizing an additive amount of alloy elements which are easy to produce carbon nitrides such as Ti and Nb, adding a proper amount of corrosion-resistant alloy elements of Cu and Ni.

(ii) Further, in order to balance high strength and high ductile toughness, a process of reducing carbon and a process of refining crystal grains are effective. Specifically, the penetration time of carbide during heating is shortened by adding a proper amount of alloy elements such as Ti and Nb and using a single structure of bainite or martensite, or a mixed structure of bainite and martensite as an original structure before heating, during hardening. A hardening process of a fine and uniform austenite structure achieved, resulting in refining of the structure. Refining of crystal grains is further promoted by rapid heating at a heating rate of 30° C./sec during hardening. This is effective in improving ductile toughness.

The present invention has been made based on the above-described findings.

(1) A high-strength stabilizer steel for vehicles having excellent corrosion resistance and low-temperature toughness, containing 0.07 to 0.20% C, more than 0.6% and 1.5% or less Si, 1 to 3% Mn, 0.1 to 1.0% Cr, 0.005 to 0.080% sAl, 0.005 to 0.060% Ti, 0.005 to 0.060% Nb, 0.070% or less Ti+Nb, 150 ppm or less N, 0.035% or less P, 0.035% or less S, 0.01 to 1.00% Cu, 0.01 to 1.00% Ni, the remainder being Fe, and unavoidable impurities; wherein a structure before molding a stabilizer is any one of a bainite, a martensite, and a mixed structure of bainite/martensite and an original austenitic crystal grain size number after a heat treatment of the stabilizer is 9 or more.

(2) A method of producing a high-strength stabilizer for vehicles having excellent corrosion resistance and low-temperature toughness, containing 0.07 to 0.20% C, more than 0.6% and 1.5% or less Si, 1 to 3% Mn, 0.1 to 1.0% Cr, 0.005 to 0.080% sAl, 0.005 to 0.060% Ti, 0.005 to 0.060% Nb, 0.070% or less Ti+Nb, 150 ppm or less N, 0.035% or less P, 0.035% or less S, 0.01 to 1.00% Cu, 0.01 to 1.00% Ni, the remainder being Fe, and unavoidable impurities, wherein a stabilizer is produced by using a steel whose structure before molding a stabilizer has any one of a bainite, a martensite, or a mixed structure of bainite/martensite and the heating process is performed by a high-frequency-induction heating process or a resistance heating process using direct current heating at a heating rate of 30° C./sec or more.

(3) A high-strength stabilizer for vehicles having excellent corrosion resistance and low-temperature toughness which is produced by using the method according to the (2).

According to the present invention, there can be provided a high-strength stabilizer steel for vehicles having a high tensile strength of 1100 MPa or more which is excellent in corrosion resistance and low-temperature toughness in a frigid corrosive environment, a method of producing the same, and components of the same. A vehicle weight is reduced by using high-strength components, thereby considerably contributing to improvement of earth environment along with fuel consumption improvement.

DETAILED DESCRIPTION OF THE INVENTION

Figure 1:
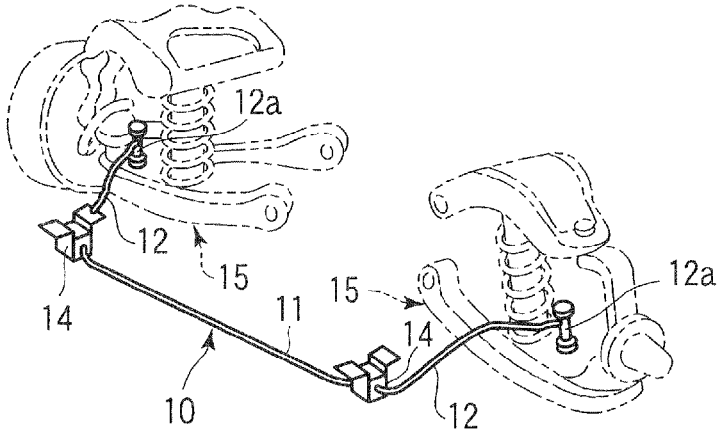
FIG. 1 is a perspective view showing an outline of a stabilizer for vehicles.

Hereinafter, restricted reasons of effects of constituent elements and manufacturing conditions in the embodiment will be respectively described. Unless otherwise noted, percentages below are by mass.

(1) C: 0.07 to 0.20%

C is a necessary element to allow the steel to maintain a predetermined strength. In order to ensure a tensile strength of 1100 MPa or more, a content of 0.07% or more of C is necessary. However, more than 0.20% of C is contained, the content of carbide is excessively increased and both corrosion resistance and toughness are reduced. Thus, the upper limit was set to 0.20%. In the embodiment, occurrence of hardening cracks and leaving cracks feared in conventional production methods is effectively prevented by using low carbon steel material having a low carbon content as a stabilizer material, thereby achieving a much safer stabilizer.

(2) Si: More than 0.6% and 1.5% or Less (0.6%<Si≦1.5%).

Si is important as a deoxidizer at the time of casting. Since it is an element effective in solid solution strengthening, it is an element important for achieving high-strength. In order to exhibit the effect, it is necessary to add more than 0.6% of Si. On the other hand, when the amount of Si is more than 1.5%, the toughness decreases. Thus, the upper limit was set to 1.5%.

(3) Mn: 1 to 3%

Mn improves hardenability and is effective as a solid-solution-strengthening element. In the case of the low carbon steel, Mn is important to maintain the strength. Mn refines a structure and is also important as an element which improves ductile toughness. In order to exhibit the effect, it is necessary to add 1% or more of Mn. On the other hand, when more than 3% of Mn is added, the content of carbide which is precipitated a low temperatures during tempering is excessively increased and both corrosion resistance and toughness are reduced. Thus, the upper limit was set to 3%.

(4) Cr: 0.1 to 1.0%

Cr is effective for improvement in hardenability and solid solution strengthening as with Mn. In the case of the low carbon steel, Cr is important to maintain the strength. In order to exhibit the effect, it is necessary to add 0.1% or more of Cr. On the other hand, when more than 1.0% of Cr is added, a Cr carbide during tempering is excessively precipitated and both toughness and corrosion resistance are reduced. Thus, the upper limit was set to 1.0%.

(5) soluble Al: 0.005 to 0.080%

Soluble Al (hereinafter simply referred to as sAl) is an important element as a deoxidizer at the time of casting. In order to exhibit the effect, it is necessary to add 0.005% or more of sAl. On the other hand, when more than 0.080% sAl is added, the content of oxide and nitride is excessively increased and both corrosion resistance and toughness are reduced. Thus, the upper limit was set to 0.080%.

(6) Ti: 0.005 to 0.060%

Ti forms a carbon nitride in steel and is an element effective for improving strength and refining a crystal grain. In order to exhibit these effects, it is necessary to add 0.005% or more of Ti. On the other hand, when more than 0.060% of Ti is added, the content of carbon nitride is excessively increased and both corrosion resistance and toughness are reduced. Thus, the upper limit was set to 0.060%.

(7) Nb: 0.005 to 0.060%

Nb forms a carbon nitride in steel and is an effective element for improving strength and refining a crystal grain. In order to exhibit these effects, it is necessary to add 0.005% or more of Nb. On the other hand, when more than 0.060% of Nb is added, the content of carbon nitride is excessively increased and both corrosion resistance and ductile toughness are reduced. Thus, the upper limit was set to 0.060%.

(8) Ti+Nb: 0.070% or Less

As described above, Ti and Nb form carbon nitrides in steel and have an effect of improving strength and toughness. A simultaneous addition of Ti and Nb produces a synergetic effect. On the other hand, when Ti and Nb are excessively added in a total amount (Ti+Nb) of more than 0.070%, the amount of carbon nitride is excessively increased and both corrosion resistance and toughness are reduced. Thus, the total additive amount (Ti+Nb) is suppressed to 0.070% or less.

(9) Cu: 0.01 to 1.00%

Cu is an element effective in improving corrosion resistance. In order to exhibit the effect, it is necessary to add 0.01% or more of Cu. On the other hand, even if more than 1.00% of Cu is added, the effect is saturated and it is not economical. Further, many surface flaws are produced during hot roiling, thereby impairing manufacturability. Thus, the upper limit was set to 1.00%.

(10) Ni: 0.01 to 1.00%

Ni is an element which improves corrosion resistance, as with Cu. In order to exhibit the effect, it is necessary to add 0.01% or more of Ni. On the other hand, ever if more than 1.00% of Ni is added, the effect is saturated and it is not economical (Ni is a rare and expensive metal element and Ni producing countries are limited). Thus, the upper limit is set to 1.00%.

(11) P: 0.035% or Less

P is an impurity element which is inevitably remained or mixed in a process of producing steel. P segregates in a crystal grain boundary, thereby reducing the toughness. Thus, the upper limit was set to 0.035%.

(12) S: 0.035% or Less

S is an impurity element which is inevitably remained or mixed in the process of producing steel, as with P. S segregates in the crystal grain boundary, thereby reducing the toughness. Further, the content of MnS which is an inclusion is excessively increased, both toughness and corrosion resistance are reduced. Thus, the upper limit was set to 0.035%.

(13) N: 150 ppm or Less

N forms a carbon nitride in steel and is an effective element for improving strength and refining a structure. When more than 150 ppm of N is added, the content of carbon nitride is excessively increased, both toughness and corrosion resistance are reduced. Thus, the upper limit is set to 150 ppm.

(14) Other Component Added Elements

In addition to the added elements, component elements such as Mo, V, B, Ca, and Pb may be further added in small amounts. When these additive amounts are limited to 1% or less (Mo), 1% or less (V), 0.010% or less (B), 0.010% or less (Ca), and 0.5% or less (Pb), respectively, the effect of the present invention is not particularly inhibited.

Mo is an element effective for improving hardenability and toughness. However, even if an excessive amount of Mo is added, the effect is saturated. As with Ni, taking into consideration economical efficiency, the upper limit is desirably set to 1%.

V is an effective element which can suppress a decrease in hardness when the steel is subjected to a tempering treatment at high temperatures and can enhance softening resistance of steel effectively. However, since V is a rare element as with Ni, its price stability is low, which results in a rise in material cost. Thus, it is desirable not to add. V as much as possible and Lao upper limit is desirably set to 1%.

B is an element which increases hardenability of steel by addition of small amounts. The increased effect of hardenability is observed when the additive amount of B is about 0.010%. Meanwhile, when the additive amount of B is more than 0.010%, the effect is saturated. Therefore, the upper limit of additive amount of B is desirably set to 0.010%.

Ca and Pb are elements which improve machinability of steel materials. When they are added, drilling workability at the end of the stabilizer is further improved.

(15) Limitation of Original Structure Before Molding Stabilizer

In the present invention, a molding process of the stabilizer may be cold or hot molding techniques and it is not particularly limited. Further, a hardening treatment is performed after the molding process of the stabilizer. An original structure before molding the stabilizer means a structure before the heat treatment to perform the hardening treatment in the case of cold and hot molding processes. That is, it indicates a state of cut round bar in the case of hot molding and indicates a state after the molding process in the case of cold molding. The state of the structure is once heated to an austenite region and subjected to hardening in cooling media such as water after the bending/molding process (in the case of hot molding) or immediately (in the case of cold molding) to obtain a desired strength. As for the original structure when heating to the austenite region (hereinafter simply referred to as an "original structure"), in the case of a ferrite pearlite structure, particularly, penetration of cementite into a pearlite structure is slow. Thus, a long heating time is needed and the structure becomes a coarse and non-uniform austenite structure. The toughness of the steel materials after the hardening process is reduced. Thus, when heating to the austenite region, penetration of carbide is rapid and a fine and uniform austenite structure is given. Therefore, the original structure is restricted to a bainite structure, a martensitic structure, or a mixed structure of these structures.

(16) Heating Conditions During Preparing Stabilizer:

In a heating method in the present invention, even if a conventional hardening furnace is used, the structure is refined by using the bainite structure, the martensitic structure, or the mixed structure of these structures as the original structure and further adding proper amounts of Ti and Nb. However, when the tensile strength is further increased to 1300 MPa or more, it is desirable to further refine the structure in order to suppress a decrease in low-temperature toughness due to the increased strength. To achieve this, it is more preferable that the structure is rapidly heated at a heating rate of 30° C./second or more by using a high-frequency-induction heating technique or a direct current heating technique. The high-frequency-induction heating technique includes a high-frequency-induction-heating coil device having a coil which simply encloses an object being heated in addition to a high-frequency-induction-heating furnace. The direct current heating technique includes a direct current heating device having a bipolar terminal for passing a current to an object being heated directly to induce resistance heating. When the heating rate is less than 30° C./sec, surface decarburization is easily induced because current heating and high-frequency heating are performed in the air. Since there is a possibility that strength may be decreased, the lower limit of the heating rate was set to 30° C./sec. The lower limit of the heating temperature is an austenitizing temperature +50° C. If the upper limit is too high, bad influences such as crystal grain coarsening and decarbonization are concerned and thus it is preferably set to less than 1050° C. Here, the term "heating during preparing the stabilizer" means a heating process when molding the stabilizer in the case of hot molding, meanwhile, it means a heating process for performing the heat treatment after the molding of the stabilizer in the case of cold molding.

(17) Old Austenite Grain Size

In the present invention, a strength level of 1100 MPa or more as desired strength is needed for the stabilizer. Thus, in order to obtain high low-temperature toughness at the strength level, the structure needs to be refined so as to have an original austenitic crystal grain size number of 9 or more. The crystal grain size was measured in accordance with regulations of JIS G 0551. Specifically, the crystal grain size number was determined by comparing a microscopically observed image with a predetermined standard drawing in an optical microscope field at a magnification of 100 times. Ten fields per sample were measured and averages of these fields were calculated and used as measured values. In the standard drawing, a minimum unit is 1 crystal grain size number. When a crystal grain in a microscopic field was between two standard drawings, the case was represented by 0.5. That is, when the crystal grain in the microscopic field (observed image) is between a standard drawing of a grain size number of 7 and a standard drawing of a grain size number of 8, the crystal grain size number is judged to be 7.5 (see Tables 3 and 4). Here, the old austenite grain size means a grain size of the austenite structure during heating for hardening.

(18) Tempering Treatment

The tempering treatment after the hardening process is an optional treatment in the present invention, and thus it may or may not be performed. This is because since the content of carbon in steel is reduced, when it is within the limited scope of the present application, even if, particularly the tempering treatment is not performed after the hardening process (even taking into consideration an increase in temperature during coating), desired strength and effects of the invention (corrosion resistance and low-temperature toughness) may be obtained.

Hereinafter, Best Mode for carrying out the Invention will be described with reference to the attached drawings and tables.

(Configuration of Stabilizer)

As shown in FIG. 1, a stabilizer 10 includes torsion portion 11 which is extended in a width direction of the vehicle body (not shown) and a matched pair of arm portions 12 which is continuously connected from the torsion portion 11 to its both ends. The torsion portion 11 is fixed to the vehicle body side via a bush 14 or the like. Terminals 12*a* of the arm portions 12 are connected to both suspension mechanisms 15 via stabilizer links (not shown) or the like. In the torsion portion 11 and the arm portions 12, two or more portions or about ten portions are subjected to a bending process to avoid interferences with other components in the usual case.

The stabilizer 10 has a spring function in which an upside down phase is input to the suspension mechanism 15 when a vehicle rotates, both of the arm portions 12 are bowed in an opposite direction, the torsion portion 11 is twisted, and then an excessive tilt (horizontal shaking) of the vehicle body is suppressed.

(Production example 1 of stabilizer)

Figure 2:
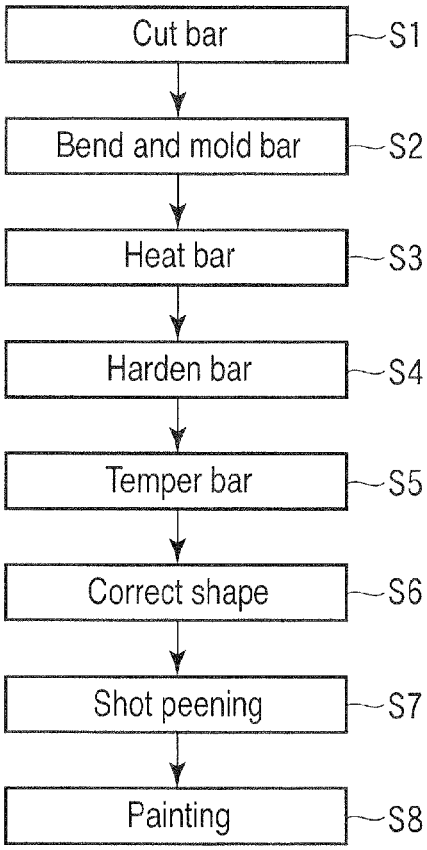
FIG. 2 is a flow chart showing an example of a method of producing the stabilizer for vehicles of the embodiment.

Subsequently, Production example 1 of stabilizer will be described using FIG. 2. A round bar was cut into a predetermined length (step S1), banded and molded into a desired shape shown in FIG. 1 (step S2), heated to an austenite temperature range in a conventional heating furnace or using a resistance heating device or a high frequency heating device (step S3), hardened in water (step S4), and subjected to the tempering treatment immediately after hardening (step S5). The thermally-deformed stabilizer bar as corrected into a desired stabilizer shape (step S6) and this was subjected to shot peening (step S7), followed by painting with a desired paint (step S8). In the present invention, among the above-described producing steps, step S5 of tempering treatment can be omitted. When a restricted hardening process is performed, step S6 of shape correction can also be omitted.

(Production example 2 of stabilizer)

Figure 3:
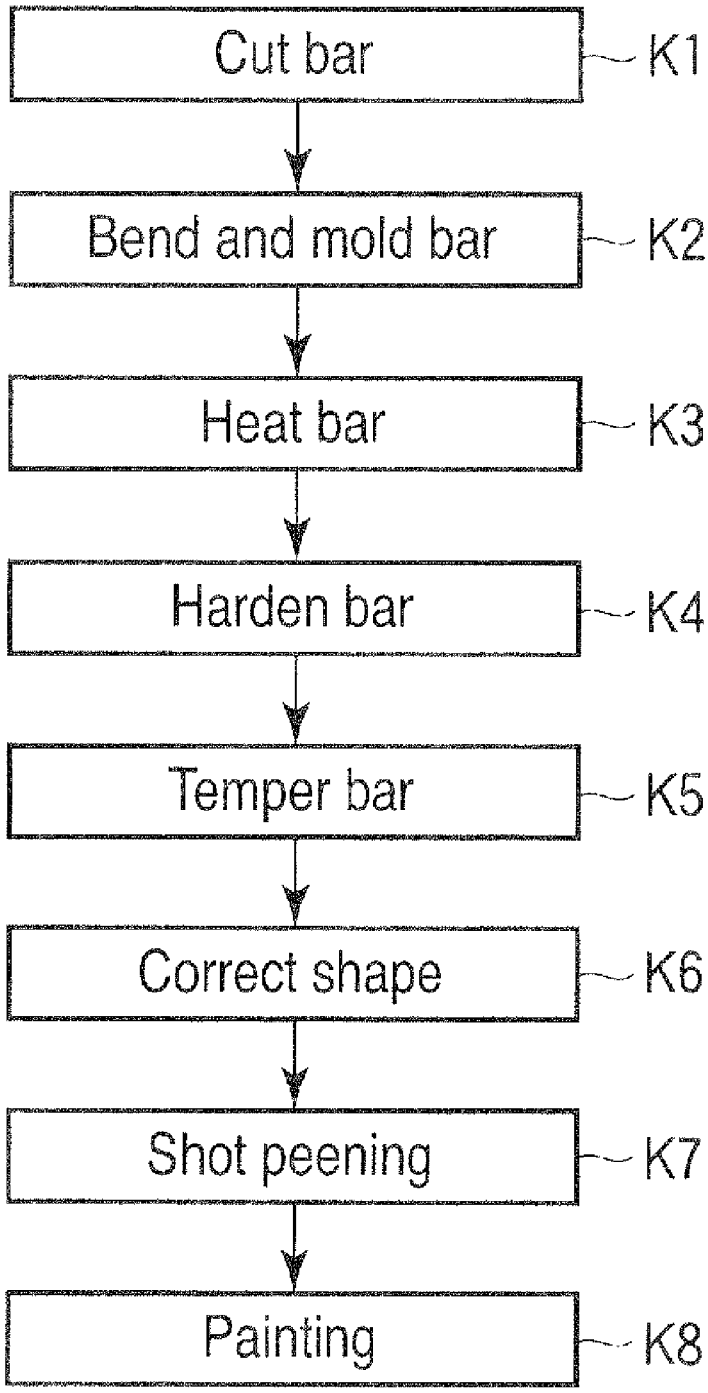
FIG. 3 is a flow chart showing another example of a method of producing the stabilizer for vehicles of the embodiment.

Subsequently, Production example 2 of stabilizer will be described using FIG. 3. A round bar was cut into d predetermined length (step K1), heated to an austenite temperature range in a conventional heating furnace or using a resistance heating device or a high frequency heating device (step K2), banded and molded into a desired shape shown in FIG. 1 (step K3), hardened in water (step K4), and subjected to the tempering treatment immediately after hardening (step K5). The thermally-deformed stabilizer bar was corrected into a desired stabilizer shape (step K6) and this was subjected to shot peening (step K7), followed by painting with a desired paint (step K8). In the present invention, among the above-described producing steps, step K5 of tempering treatment can be omitted. When the restricted hardening process is performed, step K6 of shape correction can also be omitted.

EXAMPLES

Hereinafter, Examples of the present invention will be described with reference to Tables 1 to 4 while comparing with Controls.

Steels containing various chemical composition as shown in Table 1 were casted (150 kg) by experimental dissolution and then formed into steel ingots. Then, each of the ingots was welded to a 160-mm angular billet and a material having a diameter of 25 mm was prepared by hot-rolling. A round bar-shaped specimen having a diameter of 20 mm was taken from the material, followed by a hardening and tempering treatment. Then, the tension test, impact test, corrosion resistance test, original austenite crystal grain size test were performed.

(1) The hardening treatment was performed using the conventional heating furnace for hardening as a heating furnace. The chemical components of the steels and Equation below were used and the components were heated at an austenitizing temperature of (AC3)+50° C. (rounding up one decimal place) determined by calculation for 30 minutes, followed by performing the hardening process. In the tempering treatment, a tempering temperature was adjusted so as to have a tensile strength of about 1250 MPa. A minimum temperature for tempering was set to 180° C. This is because the coating is performed at the end of the producing process of the stabilizer and the material temperature in this case is increased to about 180° C.

$$AC3(^\circ\,C.)=908-2.237\times\%\,C\times100+0.4385\times\%\,P\times1000+0.3049\times\%\,Si\times100-0.3443\times\%\,Mn\times100-0.23\times\%\,Ni\times100+2\times(\%\,C\times100-54+0.06\times\%\,Ni\times100)$$

(adopted from Netsu Shori Gijutsu Binran (Technical Reference Manual for heat treatment techniques), P 81)

(2) The tension test was performed using a JIS No. 4 specimen.

(3) The impact test was performed using a specimen of JIS No. 3 (U notch depth: 2 mm) and the test temperature was minus 40° C. In evaluation of the low-temperature toughness in Table 2, the specimen whose absorption energy measurement value was less than 40 (J/cm2) was judged as rejectable (mark x), while the specimen whose absorption energy measurement value was 40 (J/cm2) or more was judged as acceptable (mark ○).

(4) In the corrosion resistance test, a plate-shaped specimen of 20 mm in width, 50 mm in length, and 5 mm in thickness was taken from a round bar material which had been subjected to the heat treatment so as to have a predetermined strength. Wet-dry cyclic corrosion test was performed by using a portion of a range of 15 mm in width and 40 mm in length in the plate-shaped specimen as a corrosion surface (other portions than the portion were masked). Then, the corrosion weight loss was measured.

Wet-dry cyclic conditions were as follows: <5% NaCl, 35° C.>*8 hours+<50% RH, 35° C.>*16 hours=1 cycle. The cycle was performed 10 times. Corrosion weight loss was calculated by measuring weights before and after the corrosion test and dividing them by corrosion area. Rusts were removed using 20% ammonium hydrogen citrate solution at 80° C.

In evaluation of the corrosion resistance shown in Table 2, the specimen whose corrosion weight loss value was 1000 (g/m2) or more was judged as rejectable (mark x), while the specimen whose corrosion weight loss value was less than 1000 (g/m2) was judged as acceptable (mark ○).

(5) Judgment of the original austenite crystal grain size was performed in accordance with JIS-G-0551, crystal grains were emerged by a hardening and tempering method (Gh), and the judgment was performed by comparing with the standard drawing.

(Evaluation Results)

In Table 1, the chemical components, original structure before heat treatment, and original austenite crystal grain size of Examples 1 to 10 (Steel Nos. 16 to 25) were steel stocks within the scope of present invention and the tensile strength had a high level of 1200 MPa or more. Despite that, as shown in Table 2, the results showed that the corrosion weight loss was less than 1000 (g/m2), the corrosion resistance was excellent, an impact resistance value at an impact test temperature of −40° C. was 100 (J/cm2) or more, and the low-temperature toughness was also excellent.

As for Controls 1 to 15 (Steel Nos. 1 to 15) in Table 1, chemical composition of steels fall out of the scope of the present invention. Among them, particularly Control 15 (Steel No. 15) is composed of JIS SUP9.

In Control 1, even if the tempering treatment was performed at 180° C., the tensile strength was 983 MPa due to a too low content of C. Thus, the desired strength was not obtained. MnS of the inclusion was largely precipitated due to a too high content of S, resulting in reduction in both toughness and corrosion resistance.

In Control 2, carbide was excessively precipitated due to a too high content of C (0.4%). As a result, both corrosion resistance and low-temperature toughness were inferior.

In Control 3, even if the tempering treatment was performed at 180° C., the tensile strength was 1015 MPa due to a too low content of Si (0.45%). Thus, the desired strength was not obtained. Further, carbon nitride was excessively precipitated due to a too high content of Nb. As a result, both toughness and corrosion resistance were inferior.

In Control 4, the low-temperature toughness was inferior due to a too high content of Si and the corrosion resistance was inferior due to a too low content of Cu.

In Control 5, even if the tempering treatment was performed at 180° C., the tensile strength was 1010 MPa due to a too low content of Mn. Thus, the desired strength was not obtained. Further, the content of carbon nitride was excessively increased due to a too high content of Ti and both toughness and corrosion resistance were inferior.

In Control 6, the toughness was inferior due to a too high content of Mn and the corrosion resistance was inferior due to a too low content of Ni.

In Control 7, even if the tempering treatment was performed at 180° C., the tensile strength was 1023 MPa due to a too low content of Cr. Thus, the desired strength was not obtained. Further, the toughness was inferior due to a too high content of P.

In Control 8, the content of carbide was excessively increased due to a too high content of Cr and both toughness and corrosion resistance were inferior.

In Control 9, deoxidation became insufficient and the content of oxide was excessively increased due to a too low content of sAl. Thus, both toughness and corrosion resistance were reduced.

Control 10 is an example when the content of sAl is too high. The content of oxide such as Al203 or nitride such as AlN was excessively increased and both toughness and corrosion resistance were reduced.

Control 11 is an example when the content of Ti is too low and Control 12 is an example when the content of Nb is too low. In Controls 11 and 12, since the original austenite crystal grains became coarse, the toughness was deteriorated.

Control 13 is an example when each of the additive amount of Ti and Nb is within the scope of the present invention, however, the total amount of both elements are too large. In Control 13, the content of carbon nitride was excessively increased and both toughness and corrosion resistance were deteriorated.

In Control 14, the content of nitride was excessively increased due to a too high content of N and both toughness and corrosion resistance were deteriorated.

Control 15 is an example where SUP9 is used as steel for stabilizers. Chemical components fall out of the scope of the present invention and the toughness is low and the corrosion resistance is also inferior.

(2) Table 3 is an example showing an influence of the original structure before heating.

In Example 5-1 (Steel No. 20), the original structure was a mixed structure of bainite and martensite which was within the scope of the present invention. On the other hand, Control 16 is an example where a material which has been converted to a mixed structure of ferrite and pearlite by a normalizing treatment is subjected to the hardening and tempering treatment and then mechanical properties are compared. When the original structure is a mixed structure of ferrite and pearlite, the crystal grain has a mixed grain size of Gh 8.0 and Gh 7.5, and thus the toughness is inferior.

(3) Table 4 shows an influence of heating rate during hardening.

In Example 5-2 (Steel No. 20), the original structure was also the mixed structure of bainite and martensite which was within the scope of the present invention and a furnace heating process was used as the heating process. In Example 5-3 (Steel No. 20), current heating process was used as the heating process. The heating rate in the current heating process of Example 5-3 is higher than that in the furnace heating process. Therefore, the structure was further refined as compared with the case of the furnace heating process of Example 5-2 and further the toughness was improved.

TABLE 1

| | | Chemical composition | | | | | | | | | | | | |
|---|---|---|---|---|---|---|---|---|---|---|---|---|---|---|
| Classification | Steel No. | C | Si | Mn | P | S | Cu | Ni | Cr | sAl | Ti | Nb | Ti + Nb | TN |
| Control 1 | Steel 1 | *0.03 | 1.20 | 2.47 | 0.031 | *0.048 | 0.49 | 0.20 | 0.54 | 0.010 | 0.015 | 0.019 | 0.034 | 46 |
| Control 2 | Steel 2 | *0.4 | 0.80 | 1.09 | 0.024 | 0.015 | 0.23 | 0.25 | 0.43 | 0.035 | 0.024 | 0.018 | 0.042 | 88 |
| Control 3 | Steel 3 | 0.11 | *0.45 | 2.33 | 0.015 | 0.027 | 0.22 | 0.35 | 0.73 | 0.005 | 0.043 | *0.19 | *0.233 | 66 |
| Control 4 | Steel 4 | 0.07 | *1.89 | 2.05 | 0.006 | 0.026 | *0.008 | 0.24 | 0.38 | 0.068 | 0.037 | 0.022 | 0.059 | 76 |
| Control 5 | Steel 5 | 0.15 | 0.98 | *0.75 | 0.012 | 0.011 | 0.64 | 0.34 | 0.86 | 0.010 | *0.31 | 0.054 | *0.364 | 45 |
| Control 6 | Steel 6 | 0.10 | 1.32 | *3.65 | 0.008 | 0.017 | 0.49 | *0.005 | 0.30 | 0.012 | 0.034 | 0.030 | 0.064 | 55 |
| Control 7 | Steel 7 | 0.12 | 1.48 | 1.10 | *0.045 | 0.017 | 0.70 | 0.39 | *0.05 | 0.041 | 0.056 | 0.010 | 0.066 | 60 |
| Control 8 | Steel 8 | 0.17 | 0.89 | 1.33 | 0.012 | 0.026 | 0.89 | 0.24 | *1.36 | 0.076 | 0.024 | 0.030 | 0.055 | 32 |
| Control 9 | Steel 9 | 0.12 | 1.30 | 0.71 | 0.020 | 0.007 | 0.22 | 0.14 | 0.46 | *0.002 | 0.051 | 0.015 | 0.066 | 93 |
| Control 10 | Steel 10 | 0.15 | 1.48 | 1.13 | 0.010 | 0.025 | 0.60 | 0.19 | 0.60 | *0.12 | 0.012 | 0.055 | 0.067 | 118 |
| Control 11 | Steel 11 | 0.20 | 0.96 | 2.47 | 0.025 | 0.026 | 0.40 | 0.12 | 0.88 | 0.069 | *0.001 | 0.061 | 0.062 | 88 |
| Control 12 | Steel 12 | 0.09 | 1.44 | 1.64 | 0.014 | 0.016 | 0.43 | 0.22 | 1.00 | 0.013 | 0.014 | *0.004 | 0.018 | 78 |
| Control 13 | Steel 13 | 0.18 | 1.13 | 2.31 | 0.006 | 0.008 | 0.35 | 0.20 | 0.58 | 0.065 | 0.07 | 0.028 | *0.098 | 108 |
| Control 14 | Steel 14 | 0.15 | 1.03 | 1.54 | 0.017 | 0.010 | 0.55 | 0.01 | 0.90 | 0.026 | 0.027 | 0.013 | 0.040 | *161 |
| Control 15 (JIS SUP9) | Steel 15 | 0.57 | 0.18 | 0.83 | 0.013 | 0.010 | 0.13 | 0.02 | 0.82 | 0.025 | — | — | — | 55 |
| Example 1 | Steel 16 | 0.12 | 0.75 | 1.90 | 0.011 | 0.008 | 0.11 | 0.36 | 0.47 | 0.020 | 0.005 | 0.060 | 0.065 | 45 |

TABLE 1-continued

| Classification | Steel No. | C | Si | Mn | P | S | Cu | Ni | Cr | sAl | Ti | Nb | Ti + Nb | TN |
|---|---|---|---|---|---|---|---|---|---|---|---|---|---|---|
| | | Chemical composition | | | | | | | | | | | | |
| Example 2 | Steel 17 | 0.14 | 0.95 | 2.10 | 0.020 | 0.015 | 0.15 | 0.07 | 0.57 | 0.040 | 0.035 | 0.035 | 0.070 | 143 |
| Example 3 | Steel 18 | 0.13 | 0.85 | 2.00 | 0.009 | 0.004 | 0.11 | 0.04 | 0.52 | 0.030 | 0.030 | 0.030 | 0.060 | 50 |
| Example 4 | Steel 19 | 0.07 | 0.75 | 1.19 | 0.013 | 0.009 | 0.12 | 0.06 | 0.25 | 0.019 | 0.021 | 0.008 | 0.029 | 68 |
| Example 5 | Steel 20 | 0.20 | 0.68 | 2.68 | 0.009 | 0.006 | 0.09 | 0.04 | 0.88 | 0.039 | 0.014 | 0.055 | 0.069 | 43 |
| Example 6 | Steel 21 | 0.17 | 0.85 | 1.40 | 0.019 | 0.007 | 0.26 | 0.48 | 0.18 | 0.033 | 0.030 | 0.005 | 0.035 | 78 |
| Example 7 | Steel 22 | 0.07 | 1.05 | 1.72 | 0.022 | 0.016 | 0.31 | 0.22 | 0.91 | 0.044 | 0.022 | 0.027 | 0.049 | 83 |
| Example 8 | Steel 23 | 0.09 | 0.99 | 1.36 | 0.027 | 0.006 | 0.65 | 0.07 | 0.17 | 0.076 | 0.011 | 0.012 | 0.023 | 80 |
| Example 9 | Steel 24 | 0.11 | 0.86 | 2.39 | 0.013 | 0.009 | 0.21 | 0.15 | 0.99 | 0.036 | 0.064 | 0.005 | 0.069 | 59 |
| Example 10 | Steel 25 | 0.16 | 1.27 | 1.05 | 0.025 | 0.011 | 0.04 | 0.55 | 0.33 | 0.007 | 0.048 | 0.019 | 0.067 | 39 |
| Example 11 | Steel 26 | 0.10 | 1.50 | 2.33 | 0.016 | 0.022 | 0.88 | 0.01 | 0.55 | 0.026 | 0.025 | 0.033 | 0.058 | 41 |
| Example 12 | Steel 27 | 0.15 | 0.78 | 1.39 | 0.012 | 0.021 | 0.05 | 0.95 | 0.11 | 0.063 | 0.007 | 0.044 | 0.051 | 86 |
| Example 13 | Steel 28 | 0.08 | 1.41 | 2.41 | 0.009 | 0.007 | 0.09 | 0.65 | 0.74 | 0.051 | 0.009 | 0.037 | 0.046 | 72 |
| Example 14 | Steel 29 | 0.09 | 1.32 | 2.39 | 0.008 | 0.013 | 0.40 | 0.74 | 0.61 | 0.047 | 0.048 | 0.013 | 0.061 | 68 |
| Example 15 | Steel 30 | 0.14 | 0.71 | 1.19 | 0.023 | 0.009 | 0.31 | 0.15 | 0.55 | 0.044 | 0.037 | 0.007 | 0.044 | 102 |

Note:
Values marked * fall out of the scope of the present invention.

TABLE 2

Judgment of mechanical characteristics, corrosion resistance, and original austenite grain size

| Classification | Steel No. | Original structure | AC3 | Hardening temperature | Tempering temperature | TS (MPa) | EL (%) | RA (%) |
|---|---|---|---|---|---|---|---|---|
| Control 1 | Steel 1 | B | 822 | 870 | 180 | 983 | 25.6 | 75.1 |
| Control 2 | Steel 2 | M | 846 | 900 | 480 | 1231 | 9.2 | 36.9 |
| Control 3 | Steel 3 | B | 794 | 850 | 180 | 1015 | 22.1 | 68.9 |
| Control 4 | Steel 4 | B | 845 | 900 | 350 | 1207 | 9.5 | 42.4 |
| Control 5 | Steel 5 | B + M | 862 | 920 | 180 | 1010 | 9.8 | 29.7 |
| Control 6 | Steel 6 | B | 775 | 830 | 400 | 1211 | 10.0 | 36.4 |
| Control 7 | Steel 7 | B | 880 | 920 | 180 | 1023 | 15.7 | 66.7 |
| Control 8 | Steel 8 | B + M | 840 | 890 | 400 | 1244 | 8.4 | 32.8 |
| Control 9 | Steel 9 | B | 879 | 930 | 400 | 1236 | 9.2 | 30.5 |
| Control 10 | Steel 10 | B + M | 865 | 920 | 400 | 1228 | 9.6 | 36.5 |
| Control 11 | Steel 11 | B + M | 810 | 860 | 430 | 1284 | 9.3 | 43.2 |
| Control 12 | Steel 12 | B | 849 | 900 | 350 | 1217 | 8.9 | 39.3 |
| Control 13 | Steel 13 | B + M | 811 | 870 | 420 | 1274 | 9.3 | 31.0 |
| Control 14 | Steel 14 | B + M | 842 | 900 | 420 | 1264 | 10.5 | 12.8 |
| Control 15 (JIS SUP9) | Steel 15 | M | 829 | 880 | 400 | 1223 | 9.7 | 35.7 |

| Classification | uE-40 ($J/cm^2$) | Evaluation of low-temperature toughness | Gh | Corrosion weight loss ($g/m^2$) | Evaluation of corrosion resistance |
|---|---|---|---|---|---|
| Control 1 | 31 | X | 10.5 | 1160.5 | X |
| Control 2 | 41 | X | 9.5 | 1091.8 | X |
| Control 3 | 37 | X | 10.5 | 1292.8 | X |
| Control 4 | 44 | X | 10.5 | 1096.6 | X |
| Control 5 | 39 | X | 10.0 | 1149.4 | X |
| Control 6 | 42 | X | 10.5 | 1240.5 | X |
| Control 7 | 28 | X | 10.5 | 512.7 | ○ |
| Control 8 | 33 | X | 10.5 | 1255.9 | X |
| Control 9 | 29 | X | 8.0 | 1461.6 | X |
| Control 10 | 30 | X | 10.0 | 1299.5 | X |
| Control 11 | 26 | X | 8.0 | 467.6 | ○ |
| Control 12 | 37 | X | 8.0 | 509.6 | ○ |
| Control 13 | 40 | X | 10.0 | 1410.4 | X |
| Control 14 | 31 | X | 11.0 | 1317.3 | X |
| Control 15 (JIS SUP9) | 33 | X | 8.0 | 1461.6 | X |

| Classification | Steel No. | Original structure | AC3 | Hardening temperature | Tempering temperature | TS (MPa) | EL (%) | RA (%) |
|---|---|---|---|---|---|---|---|---|
| Example 1 | Steel 16 | B | 815 | 870 | 400 | 1230 | 16.0 | 65.8 |
| Example 2 | Steel 17 | B | 821 | 880 | 400 | 1255 | 15.9 | 64.6 |
| Example 3 | Steel 18 | B | 817 | 870 | 400 | 1235 | 15.9 | 64.3 |
| Example 4 | Steel 19 | B | 845 | 900 | 200 | 1205 | 21.6 | 70.1 |
| Example 5 | Steel 20 | B + M | 787 | 860 | 480 | 1265 | 15.3 | 62.7 |
| Example 6 | Steel 21 | B + M | 837 | 890 | 380 | 1233 | 14.8 | 64.2 |
| Example 7 | Steel 22 | B | 838 | 890 | 400 | 1223 | 19.8 | 68.7 |

TABLE 2-continued

Judgment of mechanical characteristics, corrosion resistance, and original austenite grain size

| | | | | | | | | |
|---|---|---|---|---|---|---|---|---|
| Example 8 | Steel 23 | B | 852 | 910 | 200 | 1219 | 17.8 | 64.9 |
| Example 9 | Steel 24 | B | 806 | 860 | 400 | 1241 | 15.7 | 65.2 |
| Example 10 | Steel 25 | B + M | 864 | 920 | 400 | 1238 | 16.8 | 67.2 |
| Example 11 | Steel 26 | B + M | 830 | 880 | 180 | 1288 | 14.8 | 60.3 |
| Example 12 | Steel 27 | B + M | 827 | 880 | 400 | 1256 | 13.3 | 66.1 |
| Example 13 | Steel 28 | B + M | 814 | 870 | 200 | 1266 | 14.9 | 61.8 |
| Example 14 | Steel 29 | M | 811 | 860 | 200 | 1248 | 16.1 | 67.4 |
| Example 15 | Steel 30 | M | 846 | 900 | 400 | 1250 | 15.5 | 63.5 |

| Classification | uE-40 ($J/cm^2$) | Evaluation of low-temperature toughness | Gh | Corrosion weight loss ($g/m^2$) | Evaluation of corrosion resistance |
|---|---|---|---|---|---|
| Example 1 | 109 | ○ | 10.5 | 471.8 | ○ |
| Example 2 | 103 | ○ | 10.5 | 461.0 | ○ |
| Example 3 | 108 | ○ | 11.0 | 432.1 | ○ |
| Example 4 | 119 | ○ | 9.0 | 478.0 | ○ |
| Example 5 | 109 | ○ | 10.5 | 426.5 | ○ |
| Example 6 | 114 | ○ | 11.0 | 459.8 | ○ |
| Example 7 | 117 | ○ | 10.0 | 497.0 | ○ |
| Example 8 | 109 | ○ | 9.5 | 425.5 | ○ |
| Example 9 | 113 | ○ | 10.5 | 449.3 | ○ |
| Example 10 | 105 | ○ | 11.0 | 497.6 | ○ |
| Example 11 | 102 | ○ | 10.5 | 426.8 | ○ |
| Example 12 | 108 | ○ | 10.5 | 485.2 | ○ |
| Example 13 | 118 | ○ | 10.5 | 461.3 | ○ |
| Example 14 | 109 | ○ | 11.0 | 433.7 | ○ |
| Example 15 | 101 | ○ | 10.5 | 429.1 | ○ |

TABLE 3

Influence of original structure

| Classification | Steel No. | Original structure | Heating rate (° C./sec) | Hardening temperature | Tempering temperature | Gh | TS (MPa) | EL (%) | RA (%) | uE-40 ($J/cm^2$) | Evaluation of low-temperature toughness |
|---|---|---|---|---|---|---|---|---|---|---|---|
| Example 5-1 | Steel 20 | B + M | 0.1 | 880 | 480 | 10.5 | 1265 | 15.3 | 62.7 | 109 | ○ |
| Control 16 | Steel 20 | F + P | 0.1 | 880 | 480 | Mixed grain size (8.0 + 7.5) | 1260 | 10.6 | 38.1 | 36 | X |

TABLE 4

Influence of heating rate

| Classi-fication | Steel No. | Heating process | Heating rate (° C./sec) | Original structure | Hardening temperature | Tempering temperature | Gh | TS (MPa) | EL (%) | RA (%) | uE-40 ($J/cm^2$) | Evaluation of low-temperature toughness |
|---|---|---|---|---|---|---|---|---|---|---|---|---|
| Example 5-2 | Steel 20 | Furnace heating process | 0.1 | B + M | 880 | 480 | 9.5 | 1265 | 15.3 | 62.7 | 109 | ○ |
| Example 5-3 | Steel 20 | Current heating process | 100 | B + M | 930 | 480 | 11.5 | 1273 | 20.7 | 70.8 | 135 | ○ |

What is claimed is:

1. A high-strength stabilizer steel for vehicles having excellent corrosion resistance and low-temperature toughness, containing 0.07 to 0.20% C, more than 0.6% and 1.5% or less Si, 1 to 3% Mn, 0.1 to 1.0% Cr, 0.005 to 0.080% sAl, 0.005 to 0.060% Ti, 0.005 to 0.060% Nb, 0.070% or less Ti+Nb, 150 ppm or less N, 0.035% or less P, 0.035% or less S, 0.01 to 1.00% Cu, 0.01 to 1.00% Ni, the remainder being Fe, and unavoidable impurities; wherein a structure before molding a stabilizer is any one of a bainite, a martensite, and a mixed structure of bainite/martensite and an original austenitic crystal grain size number after a heat treatment of the stabilizer is Gh 9 or more.

2. A method of producing a high-strength stabilizer for vehicles having excellent corrosion resistance and low-temperature toughness, containing 0.07 to 0.20% C, more than 0.6% and 1.5% or less Si, 1 to 3% Mn, 0.1 to 1.0% Cr, 0.005 to 0.080% sAl, 0.005 to 0.060% Ti, 0.005 to 0.060% Nb, 0.070% or less Ti+Nb, 150 ppm or less N, 0.035% or less P, 0.035% or less S, 0.01 to 1.00% Cu, 0.01 to 1.00% Ni, the remainder being Fe, and unavoidable impurities, wherein a stabilizer is produced by using a steel whose structure before molding a stabilizer has any one of a bainite, a martensite, or a mixed structure of bainite/martensite and a heating process is performed by a high-frequency-induction heating process at a heating rate of 30° C./sec or more or a resistance heating process using direct current heating at a heating rate of 30° C./sec or more.

3. A high-strength stabilizer for vehicles having excellent corrosion resistance and low-temperature toughness which is produced by using the method according to claim 2.

* * * * *